US008978310B2

(12) United States Patent
Chase et al.

(10) Patent No.: US 8,978,310 B2
(45) Date of Patent: Mar. 17, 2015

(54) STAGING SYSTEM AND METHOD

(71) Applicant: Staging Concepts Acquisitions, LLC, Minneapolis, MN (US)

(72) Inventors: Jonathan M. Chase, Shoreview, MN (US); Christopher J. Altringer, Columbus, MN (US); Zach Heiling, Crystal, MN (US)

(73) Assignee: Staging Concepts Acquisitions, LLC, Minneapolis, MN (US)

( * ) Notice: Subject to any disclaimer, the term of this patent is extended or adjusted under 35 U.S.C. 154(b) by 0 days.

(21) Appl. No.: 13/956,052

(22) Filed: Jul. 31, 2013

(65) Prior Publication Data

US 2015/0033661 A1 Feb. 5, 2015

(51) Int. Cl.

| | |
|---|---|
| ***E04H 3/10*** | (2006.01) |
| ***E04H 3/24*** | (2006.01) |
| ***E04B 1/19*** | (2006.01) |

(52) U.S. Cl.

CPC ..... *E04H 3/24* (2013.01); *E04B 1/1903* (2013.01); *E04B 2001/1957* (2013.01)

USPC ..... 52/6; 52/7

(58) Field of Classification Search

USPC ..... 52/6, 7, 578, 582.2

See application file for complete search history.

(56) References Cited

U.S. PATENT DOCUMENTS

| | | | | | |
|---|---|---|---|---|---|
| 1,808,082 | A * | 6/1931 | Thompson | 52/637 |
| 3,998,562 | A * | 12/1976 | Gostling | 403/235 |
| 4,514,950 | A * | 5/1985 | Goodson, Jr. | 52/653.1 |
| 5,214,899 | A * | 6/1993 | Beeche et al. | 52/648.1 |
| 5,323,563 | A * | 6/1994 | Rogers et al. | 52/7 |
| 5,701,703 | A * | 12/1997 | Luedke et al. | 52/36.5 |
| 5,848,501 | A * | 12/1998 | Taipale et al. | 52/126.4 |
| 6,164,016 | A * | 12/2000 | Bue et al. | 52/7 |
| 6,484,450 | B1 * | 11/2002 | Suprina et al. | 52/8 |
| 6,976,557 | B2 * | 12/2005 | Becker | 182/113 |
| 7,275,888 | B1 * | 10/2007 | Christensen et al. | 404/6 |
| 7,398,626 | B2 * | 7/2008 | Greschbach | 52/650.3 |
| 7,874,115 | B2 * | 1/2011 | Thiede | 52/506.01 |
| 7,971,395 | B1 * | 7/2011 | Vigil et al. | 52/9 |
| 8,136,460 | B2 * | 3/2012 | Tait et al. | 108/157.1 |
| 2002/0078652 | A1 * | 6/2002 | Hawkes | 52/578 |

OTHER PUBLICATIONS

Strata Event Staging and Tent Floor System, Technical Sheet, Jul. 2006, 2 pages.

Strata Event Staging and Tent Floor System, Owner's Manual, Apr. 2006, 88 pages.

* cited by examiner

*Primary Examiner* — Basil Katcheves

*Assistant Examiner* — Joshua Ihezie

(74) *Attorney, Agent, or Firm* — Hollingsworth Davis, LLC

(57) ABSTRACT

A system comprising a first beam, a second beam, at least two attachment nodes, at least four support assemblies, and a platform is provided. The beams each have a top surface and a bottom surface with at least one top channel and bottom channel respectively along the length of the beams' surfaces. The channels each have a first width at the outer surface of the beam that is smaller than a second width of the channels located within the beam. The attachment nodes are secured in the at least one top channel of each of the beams. At least two support assemblies are secured to the at least one bottom channel of the first beam, and at least two support assemblies are secured to the at least one bottom channel of the second beam. The platform is positioned on the at least two attachment nodes.

18 Claims, 6 Drawing Sheets

STAGING SYSTEM AND METHOD

TECHNICAL FIELD

The present disclosure is directed to staging systems for public and private use facilities. More particularly, the present disclosure relates to a modular staging system.

BACKGROUND

Staging systems are constructed on-site. However, installation of staging systems can require tedious welding, drilling, and/or tapping. Thus, installation requires several tools, parts, and/or power sources in addition to the components of the staging system being constructed. Such systems also have limited adjustability and are not typically interchangeable with other components. Staging systems that are durable, have adaptable design capabilities, and are convenient to work with would complement both large- and small-scale construction projects.

SUMMARY

Embodiments of the disclosure are directed to a system comprising a first beam, a second beam, at least two attachment nodes, at least four support assemblies, and a platform. Each of the first and second beams has a top surface and a bottom surface. The top surface comprises at least one top channel along the length of the beam having a first top channel width at the top surface that is smaller than a second width of the top channel located within the beam. The bottom surface has at least one bottom channel along the length of the beam having a first bottom channel width at the bottom surface that is smaller than a second width of the bottom channel located within the beam. At least one attachment node is secured in the at least one top channel of the first beam, and at least one attachment node is secured in the at least one top channel of the second beam. At least two support assemblies are secured to the at least one bottom channel of the first beam, and at least two support assemblies are secured to the at least one bottom channel of the second beam. The platform is positioned on the at least two attachment nodes.

Additional components, and/or entire system sections, can be connected with the above-described system to expand a staging area. The staging system can have a variety of configurations including varying shapes, heights, and accessory features.

Further embodiments of the disclosure are directed to a method comprising providing at least two beams, where each beam has a top surface and a bottom surface. The top surface comprises at least one top channel along the length of the beam having a first top channel width at the top surface that is smaller than a second width of the top channel located within the beam. The bottom surface has at least one bottom channel along the length of the beam having a first bottom channel width at the bottom surface that is smaller than a second width of the bottom channel located within the beam. One or more attachment nodes are secured in the at least one top channel of each of the at least two beams, and two or more support assemblies are secured to the at least one bottom channel of each of the at least two beams. The at least two beams are aligned in an upright position where the at least one bottom channel faces down and the two or more support assemblies of the first beam are positioned opposite the two or more support assemblies of the second beam. A lateral brace is attached between each of the opposing support assemblies on the first and second beams. One or more platforms are positioned on the one or more attachment nodes.

These and other features and aspects of various embodiments may be understood in view of the following detailed discussion and accompanying drawings.

DETAILED DESCRIPTION

In the following description of various exemplary embodiments, reference is made to the accompanying drawings that form a part hereof, and in which is shown by way of illustration various embodiments in which this disclosure may be practiced. It is to be understood that other embodiments may be utilized, as structural and operational changes may be made without departing from the scope of the present disclosure.

To facilitate on-site construction, a modular staging system provides an alternative to complex and time consuming installations. The described staging modules can be erected with the use of minimal tools enabling efficient assembly times and reducing or removing the need for a power source at the assembly location. In addition, the staging modules use a minimal number of interchangeable components to increase assembly efficiency. The staging systems provide for flexible adjustment of modular components and are readily reconfigurable and customizable.

In accordance with various embodiments, a modular staging system includes assemblies of understructure and supporting platforms. While a single platform can be supported by four support assemblies, or legs, when linked together multiple platforms can share supporting understructure in a modular effect. The understructure of the various embodiments disclosed is based on support beams with one or more channels running along the lengths of the top and bottom surfaces of the beams. These channels are used to secure various staging components. When the top and bottom surfaces have the same number and shaped channels, the top and bottom are interchangeable. Similarly, the beams are interchangeable at different positions in an assembled staging system, e.g., edge positions and intermediate support positions. While, certain of the embodiments described herein include support assemblies, or legs, certain embodiments do not. Certain embodiments can involve beams, lateral bracing, and platforms to provide a staging floor, for example, for an already level surface or a pool cover. The described components can be assembled in a variety of configurations for customizable staging assemblies.

Figure 1:
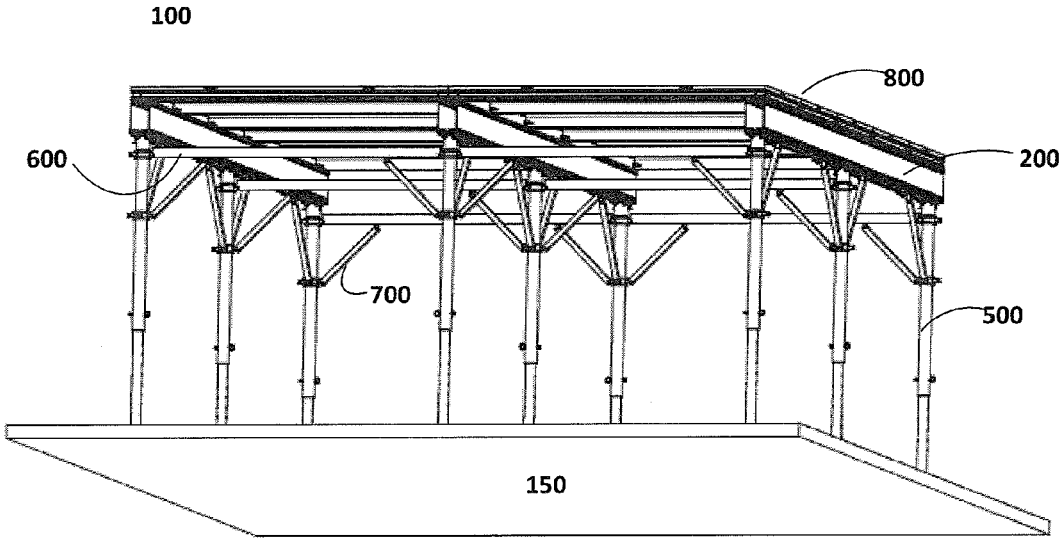
FIG. 1 is an isometric view of a staging system, in accordance with various embodiments.

In general, an assembled section 100 of a staging system includes platforms 800, support beams 200, and support assemblies 500, as shown in FIG. 1. Here, an assembled staging section 100 includes nine support assemblies 500, three support beams 200, and ten platforms 800. In addition, the assembled section 100 includes six lateral braces 600 and twenty-four diagonal braces 700. The assembled section is shown constructed on a relatively flat surface 150, e.g., the ground, or flooring. However, staging sections according to the disclosed embodiments can be constructed on a variety of uneven surfaces using adjustable support assemblies 500 or over open space using no, or a minimal number of, support assemblies 500. The assembled staging section 100 can also be connected with additional staging sections by repositioning one or more platforms 800 on beams 200. Each of these components is discussed further below.

Figure 2:
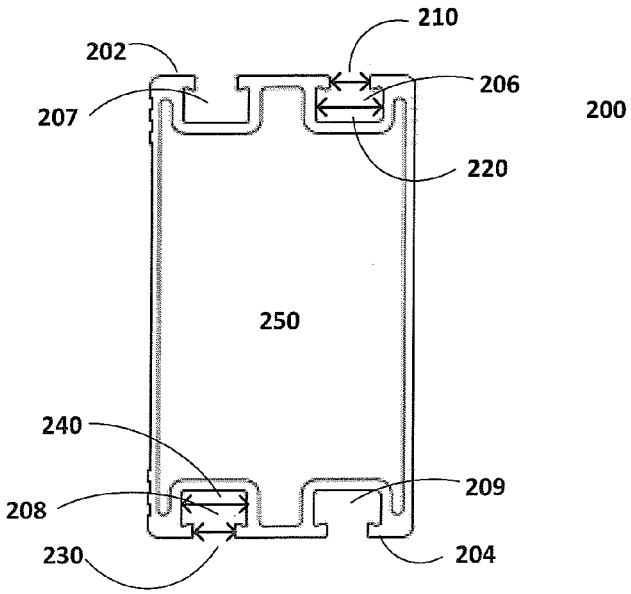
FIG. 2 is a cross-section view of a support beam, in accordance with various embodiments.

FIG. 2 illustrates the cross section of a support beam 200. The support beam includes a top surface 202 and a bottom surface 204. The top and bottom surfaces 202, 204 are flat and parallel to each other. Beam 200 can be constructed of a variety of materials such as metal, plastic, wood, etc. However, to satisfy safety and weight bearing regulations, as well as to enable efficient transport and assembly, beam 200 can be a light-weight extruded aluminum (e.g., 6061-T6 aluminum). In certain embodiments, the body, or center portion 250 of beam 200, is hollow. The exterior sides of the beam 200 can be flat or include ridges or other decorative and/or functional features. For example, beam 200 could include attachment features for wiring, storage devices, or other understructure components. Beam 200 can be a variety of lengths such as 6, 12 or 24 feet, or be customized for a specific embodiment and can be a variety of heights, e.g., 6 inches.

Each of the top and bottom surfaces includes one or more grooves, or channels 206, 207, 208, and 209. For example, beam 200 includes two top channels 206, 207 and two bottom channels 208, 209. While beam 200 is shown with four channels, the number of channels is limited only by the dimensions of the beam 200. For example, beam 200 could include two channels, one each on the top and bottom surface. Also, the top and bottom surfaces do not necessarily include the same number of channels. Each of the channels 206, 207, 208, 209 is recessed into the body of beam 200. The channels 206, 207, 208, 209 run along the length of the beam 200 and are open at at least one end of the beam 200.

As shown, the channels 206, 207, 208, 209 are shaped with varying widths. Using top channel 206 as an example, the width at the top surface 202 (shown with arrow 210) is smaller than the width of the channel 206 within the body of beam 200 (shown with arrow 220). The narrower width 210 creates a lip over both sides of the channel 206. This lip can be various shapes, for example, including a protruding portion into the channel 206 as shown. Similarly, bottom channel 208 has a width 240 larger than the width 230 at the bottom surface 204. While channels 206, 207, 208, 209 are illustrated as being rectangular, the channels can be any variety of shapes such as square, triangular, or circular. Each of the channels 206, 207, 208, 209 can have the same shape, or the shapes can differ. When each of the channels has the same shape and the top and bottom surfaces 202, 204 include the same number of channels, the top and bottom surfaces 202, 204 are interchangeable. Thus, the terms "top" and "bottom" are merely used for reference and do not denote a required configuration for beam 200. The shape of channels 206, 207, 208, 209 is designed to receive various components, such as support plates and attachment nodes, which are further discussed below.

Figure 3A:
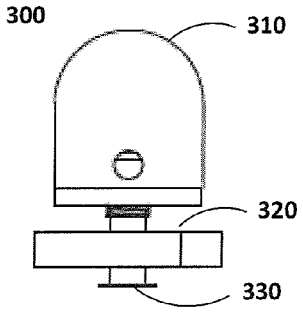
FIGS. 3A-C are respective side, perspective, and bottom-up views of an attachment node assembly, in accordance with various embodiments.
Figure 3B:
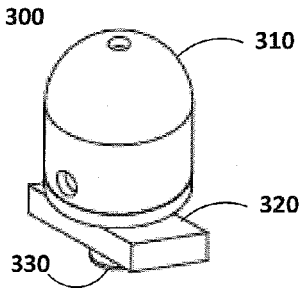
Figure 3C:
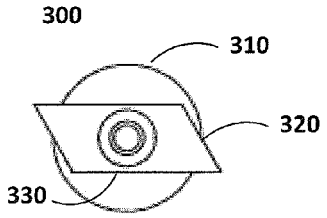

An attachment node assembly 300 is illustrated in FIGS. 3A-C. The attachment node assembly 300 includes an attachment node 310, a node nut 320, and a node washer 330. The node nut 320 is sized and shaped to be inserted into a channel of a support beam such as top channels 206, 207. Using channel 206 as an example, node nut 320 is rectangular. While the node nut 320 is located within the channel, the attachment node 310 sits on top of the support beam 200.

The node nut 320 secures the attachment node 310 at a specific location on the top surface of a support beam 200. First, the node nut 320 is rotated until it contacts node washer 330. The node nut 320 is then inserted into a beam channel, with attachment node 310 above the beam/channel. The node assembly 300 is then slid along the channel to a desired location on the beam 200. Once in position, the attachment node 310 is rotated until the node nut 320 is contacting both sides of the channel (e.g., across width 220) and the attachment node 310 is seated on the top surface of the beam 200. To facilitate contact with the sides of the channel, node nut 320 may have a parallelogram shape as shown in FIG. 3C. As discussed above, node nut 320 may have a variety of shapes corresponding to the shape of a beam channel.

Figure 4:
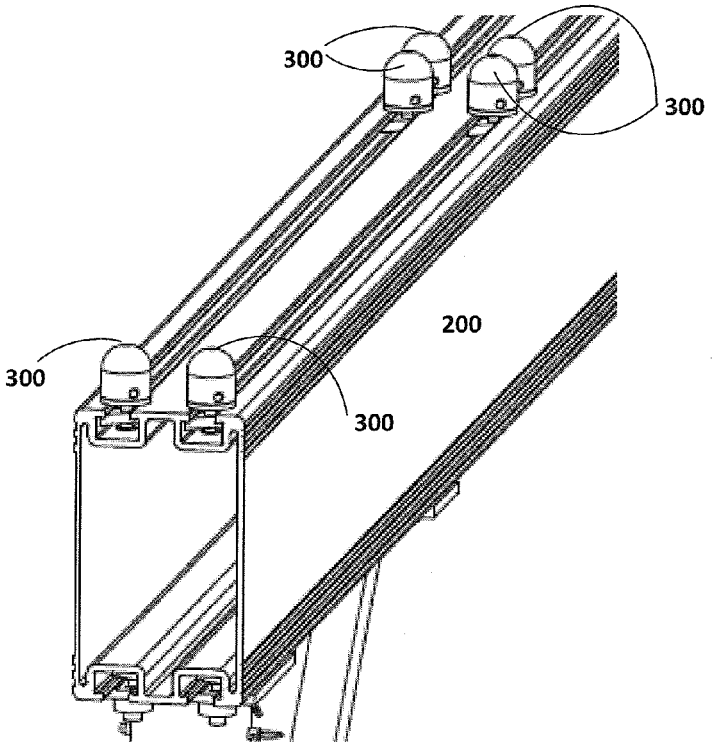
FIG. 4 is a perspective view of a support beam with attachment node assemblies engaged, in accordance with various embodiments.

FIG. 4 illustrates a plurality of attachment node assemblies 300 secured to a support beam 200. The attachment nodes 310 are positioned to align one or more platforms on a staging assembly. A platform includes one or more cavities for receiving an attachment node 310, which then positions and/or locks the platform in place on the staging assembly. Therefore, the positioning of the attachment node assemblies 300 on beam 200 dictates the alignment of the platform(s). For example, adjacent attachment node assemblies 300 in the same channel can be received by adjacent platforms. Likewise, adjacent node assemblies 300 in adjacent channels can also align adjacent platforms. The attachment node assemblies 300 can be positioned using a variety of methods including using a locator template and using predefined markings on the support beam 200.

Figure 5A:
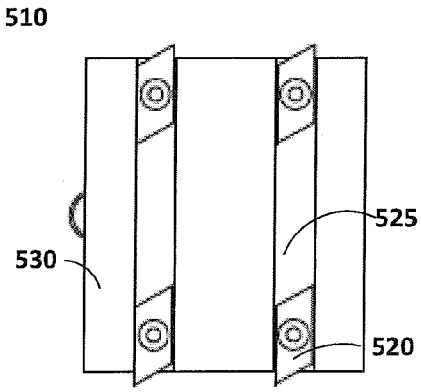
FIGS. 5A-D are respective top-down, perspective, and side views of a support assembly plate, in accordance with various embodiments.

On the opposite side of the beam from the attachment node assemblies, support assemblies are attached. The support assemblies are connected to the bottom channel(s) of the beam with a support plate 510. Various views of a support plate 510 are illustrated in FIGS. 5A-D. The top-down view of FIG. 5A illustrates four channel nuts 520, two channel nuts 520 are aligned in each of two parallel grooves 525. The grooves 525 are recessed in a top surface 530 of support plate 510. The grooves 525 are optional features of support plate 510 since the channel nuts 520 could also lay flat against the top surface 530. However, grooves 525 assist in aligning the channel nuts 520 for insertion into one or more bottom channels of a support beam.

Figure 5B:
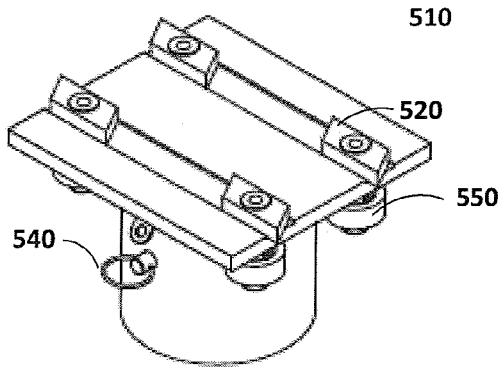
Figure 5C:
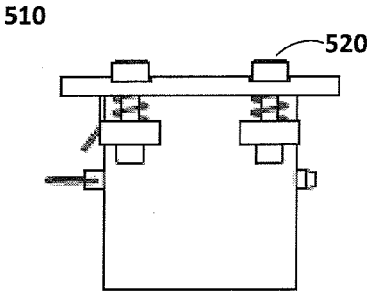
Figure 5D:
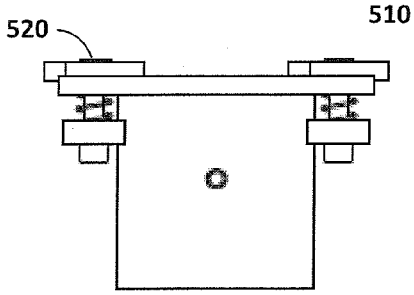

The perspective view of FIG. 5B illustrates a pin 540 used to secure the support plate 510 to a column of a support assembly. The pin 540 provides an efficient attachment and alignment mechanism that does not require additional tools. Also shown are spring-loaded bolts 550 connected to each channel nut 520. A spring-loaded bolt 550 engages a channel nut 520 by pushing the channel nut 520 up out of the groove 525. The channel nut is then turned less than one hundred eighty degrees, and preferably closer to ninety degrees, to no longer align with the groove 525. The spring-loaded bolt is then released. In the example of FIG. 5B, this would leave channel nut 520 resting on the top surface 530 of the support plate 510. However, if the channel nuts were aligned with a support beam, such as beam 200, the channel nut 520 would be inserted into a bottom channel when the spring-loaded bolt 550 is engaged and would rest inside the bottom channel on the lip when the spring-loaded bolt 550 is released. Thus, one or more channel nuts 520 secure the support plate 510 to a support beam 200. The side views of FIGS. 5C-D show that the channel nuts 520 can extend beyond the end of the grooves 525 and/or top surface 530 of the support plate 510. Similar to the node nuts 320, the channel nuts 520 may have a parallelogram shape, as shown, to facilitate contact with the sides of a beam channel. However, the channel nuts 520 may have a variety of shapes corresponding to the shape of a beam channel.

Figure 6:
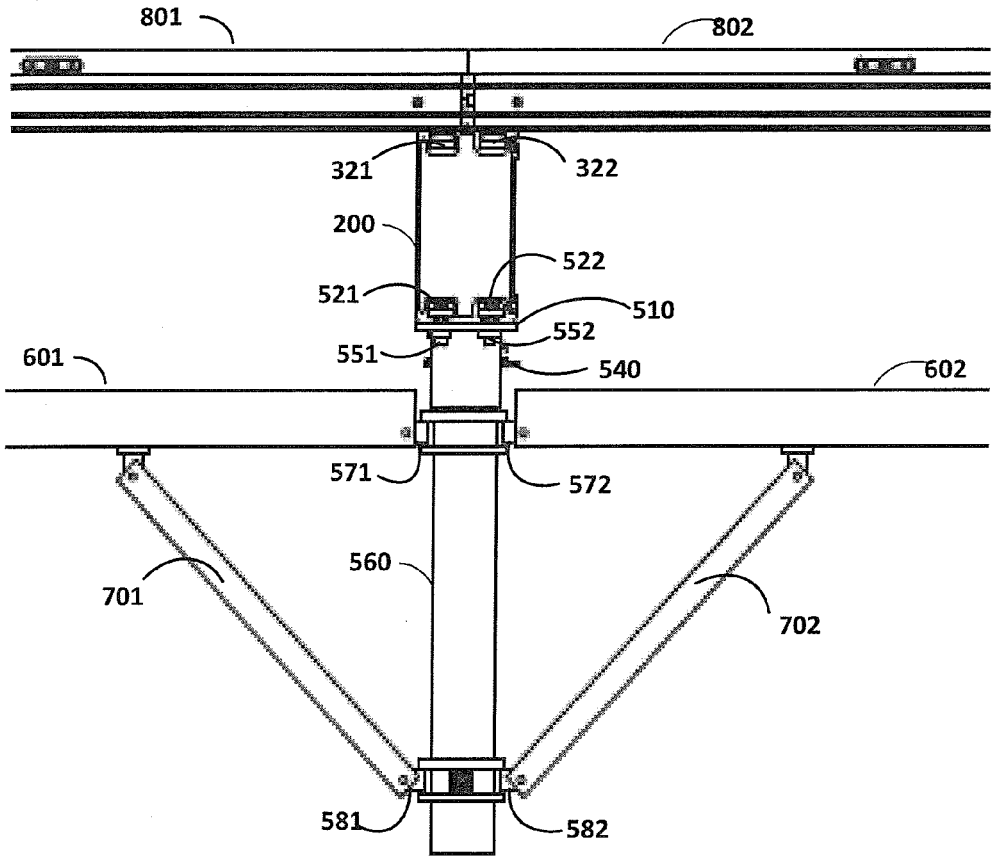
FIG. 6 is a side view of a staging system, in accordance with various embodiments.

The attachment of a support plate 510 to a beam 200 is further illustrated in the portion of an assembled staging section of FIG. 6. Support plate 510 is secured to beam 200 with first and second channel nuts 521, 522 and corresponding first and second spring-loaded bolts 551, 552. The support plate 510 is connected to a column 560 with pin 540 to form a support assembly. The column 560 is connected to additional support assemblies with first and second lateral braces 601, 602. Lateral braces 601, 602 can be of a variety of lengths, such as a length corresponding to the length of a platform. For example, lateral braces 601, 602 can provide a span of up to sixteen feet (4.88 m). The first lateral brace is secured to the column 560 with a first connector 571 of a first plurality of connectors at a first height on the column 560. The second lateral brace is secured to the column 560 with a second connector 572 of a first plurality of connectors at a first height on the column 560. While the first plurality of connectors can take a variety of shapes and sizes, the illustrated connectors 571, 572 are movable so as to slide horizontally around at least a portion of the circumference of the column 560 at the first height. This allows the connectors to be used at various positions around column 560 providing for a customizable assembly. The connectors include an aperture for receiving a pin to secure the lateral braces 601, 602 to column 560. While securing the lateral braces 601, 602 with a pin provides an efficient assembly without requiring additional tools, connectors 571, 572 can also be used with a variety of other fasteners such as screws, bolts, nails, etc.

Similarly, a second plurality of connectors at a second height on column 560 is used to secure first and second diagonal braces 701, 702 to column 560. To speed an assembly process, diagonal braces 701, 702 can be pre-attached to respective lateral braces 601, 602. Alternatively, the diagonal braces 701, 702 can be secured to the respective lateral braces 601, 602 during assembly of a staging system. The diagonal braces 701, 702 are secured to the lateral braces 601, 602 with any variety of fasteners (e.g., bolts, screws, pins) that enable the diagonal braces to rotate around the connection point. This can allow a pre-attached diagonal brace 701 to fold up into, or along, the lateral brace 601 for ease of storage and transportation. The opposing ends of the diagonal braces 701, 702 connect to the column 560 at the second plurality of connectors with a first and second connector 581, 582. Similar to the first plurality of connectors, the second plurality of connectors can take a variety of shapes and sizes, the illustrated connectors 581, 582 are movable so as to slide horizontally around at least a portion of the circumference of the column 560 at the second height. This allows the connectors to be used at various positions around column 560 providing for a customizable assembly. The connectors include an aperture for receiving a pin to secure the diagonal braces 701, 702 to column 560. While securing the diagonal braces 701, 702 with a pin provides an efficient assembly without requiring additional tools, connectors 581, 582 can also be used with a variety of other fasteners such as screws, bolts, nails, etc.

Column 560 extends to the staging support surface, for example, the ground. Column 560 can be either straight or bent to accommodate a staging area. The column 560 terminates with a ground support piece which may take many shapes, such as a stationary, flat foot or a high capacity swivel caster. A leveling rod or other height adjustable mechanism can allow hand or automatic leveling of the staging system while allowing the support assembly to support heavy loads. The components of the support assembly, including the lateral and diagonal braces, can be constructed of a variety of materials, including, for example, aluminum.

The illustrated staging section includes a first and a second platform 801, 802. The platforms can be of a variety of sizes and shapes. Platforms are constructed of any variety of materials including marine grade wood, metal, plastic, composite materials, or glass. However, the platforms must satisfy applicable safety and load bearing regulations. The first platform 801 is positioned with a first attachment node (not shown) that is secured to a first top channel in beam 200 with a first node nut 321. The second platform 802 is positioned with a second attachment node (not shown) that is secured to a second top channel in beam 200, adjacent and parallel to the first channel, with a second node nut 322. While the attachment nodes position and align the platforms 801, 802, the platforms 801, 802 can be further tightened to each other and the support structure with additional support features such as by activating coffin lock connectors between platforms, to create a uniform stage surface. The plurality of top channels in beam 200 provides for a variety of optional platform configurations using the same beam 200.

Figure 7A:
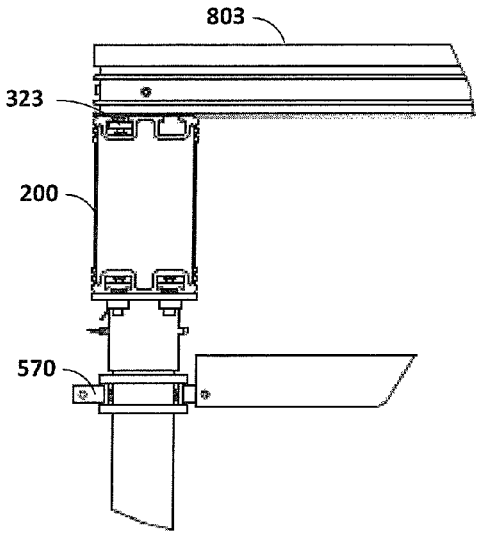
FIGS. 7A-C are side views of platform attachments to a staging system, in accordance with various embodiments.
Figure 7B:
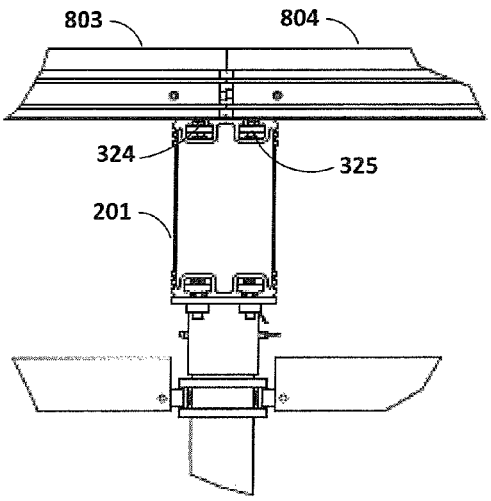
Figure 7C:
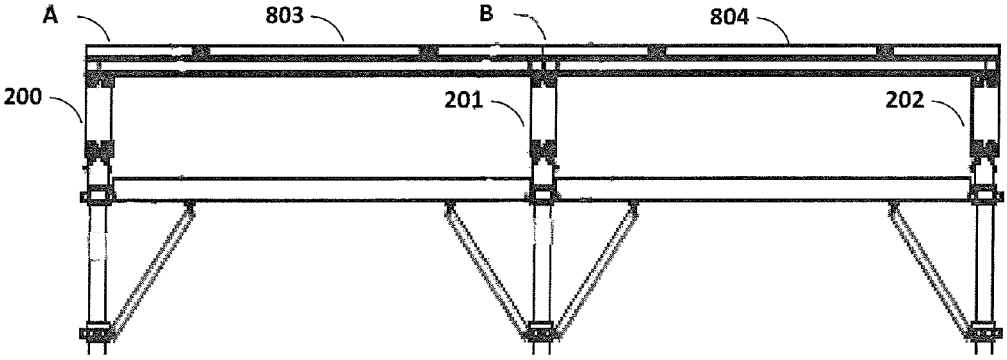

FIGS. 7A-C illustrate optional platform configurations according to embodiments of the disclosure. FIG. 7A illustrates a configuration for an edge portion of a staging assembly. Similar to FIG. 6, a support plate is secured to a beam 200 with at least two channel nuts in two adjacent bottom channels. Since the beam 200 is supporting an outer edge of the staging assembly, it needs to support one or more platforms in only one direction. Thus, platform 803 is secured to beam 200 with one or more attachment node assemblies 323 in a single, outer top channel of the two top channels. Here, the outer top channel is the left top channel. Positioning and securing platform 803 with the outer channel, provides a flush outer edge of the staging assembly. Since the illustrated staging section represents an outer edge, only one lateral brace is attached to the support assembly. This leaves one or more connectors 570 unengaged. Since the connectors can slide around the circumference of the support assembly column, connector 570 can be slid, and optionally secured, underneath platform 803 to maintain the flush outer edge of the staging assembly.

FIG. 7B illustrates a configuration for an intermediate portion of a staging assembly. FIG. 7B is similar to FIG. 6 where a single beam 201 supports platforms 803, 804 in opposing directions. Platform 803 is secured to beam 201 with at least attachment node assembly 324, while platform 804 is secured to beam 201 with at least attachment node assembly 325. The configuration of FIG. 7B can be utilized in an intermediate edge position or in a central position in a staging assembly. The relationship between the configurations of FIGS. 7A-B is illustrated in FIG. 7C.

FIG. 7C illustrates a cross-section of a staging assembly that is two platforms in width and involves three support beams 200, 201, 202. The left edge of the staging assembly utilizes the configuration of FIG. 7A. The center support is the configuration of FIG. 7B. The right edge of the staging assembly utilizes a configuration that is a mirror opposite of that of FIG. 7A. For example, platform 804 is supported by attachment node assemblies secured to the outer, right top channel of beam 202. The cross-section of FIG. 7C can be either an edge of a staging assembly or a cross-section taken from an intermediate position of the staging assembly (e.g., at the middle of the stage). Because the top and bottom channels run the length of the support beams 200, 201, 202, support plates are not required to attach directly under attachment nodes. The top and bottom support components can attach at any position along the beams so long as the resulting staging assembly is structurally supported to satisfy any applicable safety regulations. The assembly of a staging portion is further discussed below.

Figure 8:
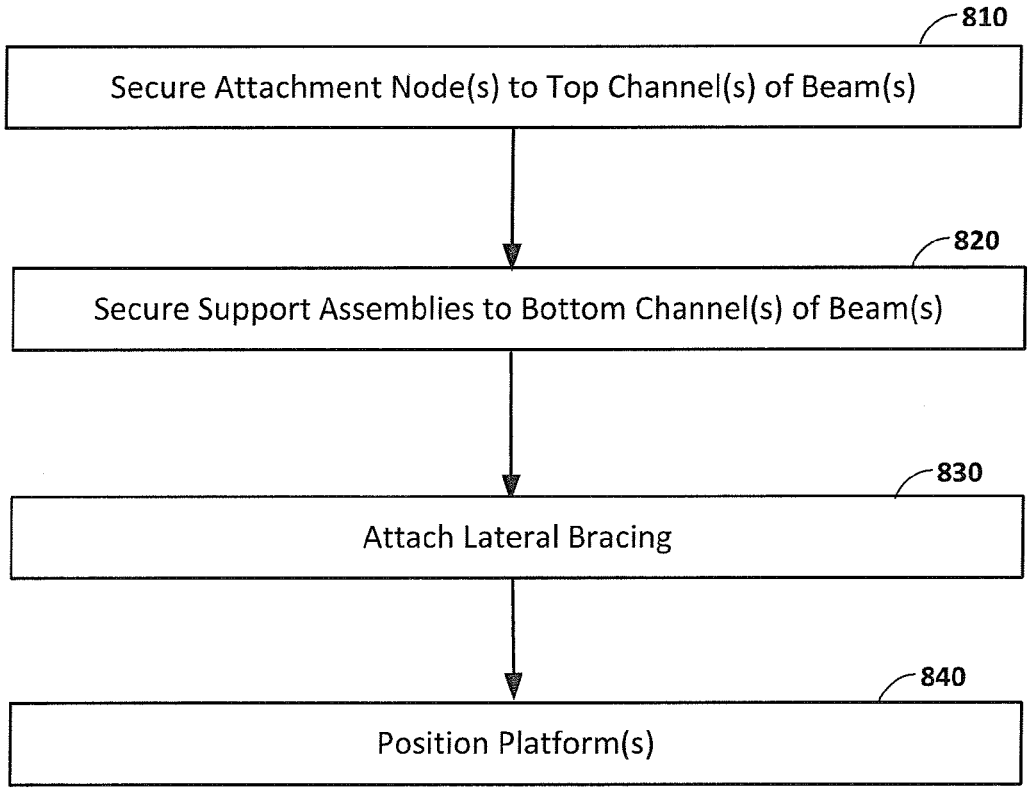
FIG. 8 is a flow chart of a method, in accordance with various embodiments.

As discussed above, assembly of the staging system requires minimal tools and components. A method of such assembly is illustrated in FIG. 8, where a section of a modular staging system is erected. In an embodiment, the components involved in a single staging section include two support beams, four attachment node assemblies, four support assemblies, two lateral braces, and one platform. The two beams each have a top surface and a bottom surface, the top surface having at least one top channel along the length of the beam. The cross-section of the channel has a horseshoe shape with a first width at the top surface being smaller than a second width of the channel located within the beam. Similarly, the bottom surface has at least one bottom channel along the length of the beam. The cross-section of the bottom surface channel also has a horseshoe shape with a first width at the bottom surface being smaller than a second width of the channel located within the beam.

To assemble the staging section, one or more attachment nodes are secured in a top channel of each of the beams 810. Here, two attachment node assemblies are secured to each of the two beams. To secure an attachment node assembly a node nut is rotated until it contacts a node washer. The node nut is then inserted into the beam channel, with the attachment node located above the beam/channel. The entire assembly is then slid along the channel to a desired location on the top of the beam. Once in position, the attachment node is rotated until the node nut contacts both sides of the channel and the attachment node is seated on the top surface of the beam. Thus, the attachment node assemblies can be secured by hand. For this configuration, the attachment node assemblies are positioned at each end of the respective beams.

Next, the support assemblies are secured to a bottom channel of each of the beams 820. In this embodiment, two support assemblies are secured to each of the two beams. Each support assembly involves a column with a support plate secured to the top and a foot or ground support piece at the opposing end. On the column are two pluralities of connectors positioned at two different heights, measured from the ground. The support plate includes one or more channel nuts, where each nut is connected to a spring-loaded bolt. One or more channel nuts are aligned with one or more bottom channels. A channel nut is then inserted into the channel by depressing the spring-loaded bolt. The bolt, and corresponding channel nut is rotated in the channel such that when the bolt is released, the channel nut rests in the channel on the edges, or lip, formed by the narrower channel opening. Engagement of the spring-loaded bolts can be performed with a single tool, e.g., a ball nose allen wrench. The support assemblies can be positioned at any point along the bottom channel. However, in the present embodiment, the two support assemblies attached to the second beam are located in positions corresponding to the support assemblies attached to the first beam. Similar to positioning the attachment node assemblies, a template, a measuring device such as a tape measure, or predetermined markings on the beam can be used to position the support assemblies.

With the support assemblies attached, the two beams are placed in an upright position, resting on the support assemblies. The two beams are aligned with their support assemblies opposing each other, and lateral braces are attached between the two sets of opposing support assemblies 830. The lateral braces are attached to a first set of connectors located at a first height on the support assembly column. The lateral braces are connected at each end to a support assembly connector. As discussed above, a variety of fasteners may be used; however, attaching the lateral braces with a pin on each end reduces the number of tools needed for the overall staging assembly process. With the lateral braces secured in place, the staging understructure is freestanding. The height of each of the support assemblies can be adjusted to level the understructure and provide a level top surface for the assembled staging section. The platform is then positioned on the attachment nodes 840. Depending on the height adjustment mechanism, the height of the staging section can be adjusted before, or after, the platform is positioned.

In addition to the lateral bracing, diagonal bracing can provide additional support to the staging section. In the above embodiment eight diagonal braces, two on each support assembly can further stabilize the staging section. A first diagonal brace can connect the lateral brace with the support assembly. As discussed above, a second plurality of connectors at a second height, usually lower than the height of the first set of connectors, is used to attach diagonal bracing. To decrease the number of tools involved in assembly, the lateral braces can have two diagonal braces pre-attached. Thus, once the lateral braces are secured, a diagonal brace can be rotated into position and attached with a pin to a connector (of the second set) on the support assembly.

A second diagonal brace can connect the same support assembly with a connector of the second set to the support beam using a support plate similar to that of the support assembly. The diagonal brace support plates can be secured to the beam when the support assemblies are secured since the diagonal brace support plates secure with the same mechanism (e.g., channel nuts with corresponding spring-loaded bolts). They can also be positioned with templates, individual measurements, or predetermined markings on the beam. When diagonal braces are pre-attached to the support beams, once the understructure is free-standing the diagonal braces can be rotated into position and attached to a connector with a pin, similar to the first diagonal brace. Since connection of the diagonal brace support plate involves the same tool(s) as connection of the support assemblies, no additional tools are required when diagonal bracing is utilized.

In addition to the above embodiment, the staging system can be arranged in a variety of configurations. For example, a single support beam can include two parallel top channels. One of the channels can be used to position and support a first platform, or set of platforms, while the second channel can be used to position and support a second platform, or set of platforms. The parallel channels are used to align adjacent platforms. Thus, the final stage area is determined by the number and sizes of the platforms used.

The modular staging system may be used with various accessories and devices. For example, seating, hand railings, stairs, risers, bridging, canopies, foot rails, signage, and other accessories may be suitably arranged at any desirable location on the staging system. These accessories may be attached to the platforms, support assemblies, or to other components attached to the staging system.

Unless otherwise indicated, all numbers expressing quantities, measurement of properties, and so forth used in the specification and claims are to be understood as being modified by the term "about." Accordingly, unless indicated to the contrary, the numerical parameters set forth in the specification and claims are approximations that can vary depending on the desired properties sought to be obtained by those skilled in the art utilizing the teachings of the present application. Not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, to the extent any numerical values are set forth in specific examples described herein, they are reported as precisely as reasonably possible. Any numerical value, however, may well contain errors associated with testing or measurement limitations.

It is to be understood that even though numerous characteristics of various embodiments have been set forth in the foregoing description, together with details of the structure and function of various embodiments, this detailed description is illustrative only, and changes may be made in detail, especially in matters of structure and arrangements of parts illustrated by the various embodiments to the full extent indicated by the broad general meaning of the terms in which the appended claims are expressed.

What is claimed is:

1. A system comprising:

a first beam and a second beam, each beam having a top surface and a bottom surface, the top surface comprising at least one top channel along the length of the beam having a first top channel width at the top surface smaller than a second width of the top channel located within the beam, and the bottom surface having at least one bottom channel along the length of the beam having a first bottom channel width at the bottom surface smaller than a second width of the bottom channel located within the beam;

at least one attachment node secured in the at least one top channel of the first beam and at least one attachment node secured in the at least one top channel of the second beam;

at least four support assemblies, wherein at least two support assemblies are secured to the at least one bottom channel of the first beam and at least two support assemblies are secured to the at least one bottom channel of the second beam, and each of the support assemblies comprises:

a column;

a first plurality of connectors at a first height on the column;

a second plurality of connectors at a second height on the column; and a support assembly plate secured to the top of the column and including at least one spring-loaded bolt coupled with a channel nut; and a platform positioned on the at least two attachment nodes.

2. The system of claim 1, wherein the first beam and the second beam each includes two top channels and two bottom channels.

3. The system of claim 1, further comprising:

a lateral brace connecting a first support assembly of the first beam with a first support assembly of the second beam, wherein the lateral brace is connected to the first support assemblies at respective connectors of the respective first pluralities of connectors.

4. The system of claim 1, further comprising:

a diagonal brace connecting a support assembly of the first beam with the first beam, wherein the diagonal brace is connected to the at least one bottom channel of the first beam with a support plate including at least one spring-loaded bolt coupled with a channel nut and a connector of the second plurality of connectors of the support assembly.

5. The system of claim 3, further comprising:

a first diagonal brace connecting the first support assembly of the first beam with the first beam, wherein the first diagonal brace is connected to the at least one bottom channel of the first beam with a support plate including at least one spring-loaded bolt coupled with a channel nut and a first connector of the second plurality of connectors of the first support assembly; and a second diagonal brace connecting the first support assembly of the first beam with the lateral brace, wherein the second diagonal brace is connected to a second connector of the second plurality of connectors of the first support assembly.

6. The system of claim 1, wherein the first and second beams are extruded aluminum, hollow beams.

7. The system of claim 1, wherein the positions of each of the first and second plurality of connectors are adjustable around at least a portion of the circumference of the column.

8. The system of claim 1, wherein the platform includes at least two cavities for receiving an attachment node and the platform is secured by positioning an attachment node in each of the at least two cavities.

9. The system of claim 1, wherein the second beam includes a first top channel and a second top channel with attachment nodes secured at the same position in each channel in pairs and the platform is supported by attachment nodes in the first channel and a second platform is supported by attachment nodes in the second channel.

10. The system of claim 9, wherein the second platform is further supported by a third beam connected to at least two additional support assemblies and having at least one additional attachment node secured to at least one top channel of the third beam.

11. The system of claim 1, wherein a distance between the first and second beam is at least nine feet.

12. The system of claim 1, further comprising:

a first diagonal brace connecting the first support assembly of the first beam with the first beam, wherein the first diagonal brace is connected to the at least one bottom channel of the first beam with a support plate including at least one spring-loaded bolt coupled with a channel nut and a first connector of the second plurality of connectors of the first support assembly; and a second diagonal brace connecting the first support assembly of the first beam with the first beam, wherein the second diagonal brace is connected to the at least one bottom channel of the first beam with a support plate including at least one spring-loaded bolt coupled with a channel nut and a second connector of the second plurality of connectors of the first support assembly.

13. A method comprising:

providing at least two beams, each beam having a top surface and a bottom surface, the top surface comprising at least one top channel along the length of the beam having a first top channel width at the top surface smaller than a second width of the top channel located within the beam, and the bottom surface having at least one bottom channel along the length of the beam having a first bottom channel width at the bottom surface smaller than a second width of the bottom channel located within the beam;

securing one or more attachment nodes in the at least one top channel of each of the at least two beams;

securing two or more support assemblies to the at least one bottom channel of each of the at least two beams, comprising:

aligning at least one channel nut of a top plate of a first support assembly with the at least one bottom channel;

engaging a first spring-loaded bolt connected to the at least one channel nut to secure the channel nut into the at least one bottom channel; and repeating the aligning and engaging for each channel nut of each support assembly;

aligning the at least two beams in an upright position, an upright position being the at least one bottom channel facing down, with the two or more support assemblies of the first beam opposing the two or more support assemblies of the second beam;

attaching a lateral brace between each of the opposing support assemblies on the first and second beams; and positioning one or more platforms on the one or more attachment nodes.

14. The method of claim 13, further comprising:

attaching one or more diagonal braces to one or more of the two or more support assemblies.

15. The method of claim 14, wherein attaching one or more diagonal braces includes securing at least one of the one or more diagonal braces to one of the beams, comprising:

aligning at least one channel nut of a support plate of the at least one diagonal brace with the at least one bottom channel of the beam;

engaging a first spring-loaded bolt connected to the at least one channel nut to secure the channel nut into the at least one bottom channel; and repeating the aligning and engaging for each channel nut of the support plate.

16. The method of claim 13, further comprising:

adjusting the height of each of the two or more support assemblies to provide a level top surface for the one or more platforms.

17. The method of claim 13, wherein at least one of the at least two beams includes two, parallel top channels and an attachment node secured to a first top channel positions a first platform and an attachment node secured to a second top channel positions a second platform.

18. The method of claim 17, wherein the first and second platforms are adjacent.

* * * * *